US005727255A

United States Patent [19]

Minks

[11] Patent Number: 5,727,255

[45] Date of Patent: Mar. 17, 1998

[54] CLOTHING FOR PHYSICALLY IMPAIRED

[76] Inventor: Janice R. Minks, 9344 Sonia St., Orlando, Fla. 32825

[21] Appl. No.: 743,165

[22] Filed: Nov. 4, 1996

[51] Int. Cl.[6] ..... A41D 1/00

[52] U.S. Cl. ..... 2/69; 2/695; 2/912

[58] Field of Search ..... 2/46, 52, 51, 50, 2/69, 69.5, 79, 114, 115, 107, 112, 117, 75, 80, 83, 912, 913, 914, 915, 919, 88, 89, 78.1, 78.2, 78.3, 78.4

[56] References Cited

U.S. PATENT DOCUMENTS

| | | | |
|---|---|---|---|
| 1,072,469 | 9/1913 | Johnson | 2/114 |
| 1,236,586 | 8/1917 | Milkes | 2/69 |
| 1,265,539 | 5/1918 | Slater | 2/69.5 |
| 1,370,009 | 3/1921 | Ehrenberg | 2/114 |
| 1,706,224 | 3/1929 | Foote | 2/69 |
| 1,998,051 | 4/1935 | Gerber | 2/114 |
| 2,030,091 | 2/1936 | Behringer | 2/114 |
| 2,504,534 | 4/1950 | Kephart et al. | 2/114 |
| 2,638,598 | 5/1953 | Abramson | 2/114 |
| 2,677,826 | 5/1954 | Piacenza | 2/115 |
| 2,716,239 | 8/1955 | Barndollar | 2/69.5 |
| 2,768,383 | 10/1956 | De Witt | 2/114 |
| 3,229,305 | 1/1966 | Nevitt | 2/114 |
| 3,363,141 | 1/1968 | Doster | 2/69.5 |
| 3,721,998 | 3/1973 | Meyers | 2/114 |
| 3,727,238 | 4/1973 | Wolfson | 2/919 |
| 3,739,399 | 6/1973 | Sheahon | 2/69.5 |
| 3,965,487 | 6/1976 | Mazur | 2/69.5 |
| 4,363,141 | 12/1982 | Doster | 2/69.5 |
| 4,383,335 | 5/1983 | Slocum | 2/114 |
| 4,485,494 | 12/1984 | Segol | 2/115 |
| 4,534,065 | 8/1985 | Comfort | 2/69.5 |
| 4,644,590 | 2/1987 | Pincham | 2/115 |
| 4,665,564 | 5/1987 | Bogart et al. | 2/115 |
| 4,811,429 | 3/1989 | Perez | 2/69.5 |
| 4,932,077 | 6/1990 | Dobbs | 2/69.5 |
| 4,944,042 | 7/1990 | DeWan | 2/94 |
| 5,044,031 | 9/1991 | Sherwood | 2/69.5 |
| 5,062,159 | 11/1991 | Jakub | 2/114 |
| 5,283,909 | 2/1994 | Hill | 2/69 |

FOREIGN PATENT DOCUMENTS

| | | | |
|---|---|---|---|
| 1255207 | 1/1961 | France | 2/914 |

OTHER PUBLICATIONS

Gershman, Maurice, "Self Adhering Nylon Tapes." The J.A.M.A, vol. 68, #7, Oct. 1958, p. 930.

*Primary Examiner*—Jeanette E. Chapman
*Attorney, Agent, or Firm*—Edward M. Livingston, Esq.

[57] ABSTRACT

Clothing for physically impaired people has a top garment section (1) and a bottom garment section (8) with which a physically impaired person (24) is dressed while in a wheelchair (25), or other handicap or normal furniture. The top garment section has arm sleeves (2), a wraparound torso enclosure (10, 17) with rear fastening (4), attachment-strap fasteners (5) and hand covers in the sleeves. The bottom garment section has wraparound abdomen enclosure (17), wraparound thigh enclosure (13), lower-leg wraparound enclosure (15), and wraparound feet-and-base enclosure (12, 16) with respectively select rear fastening. The bottom garment section is attachable to the top garment section. A selection of attachment means (4, 19, 20, 21, 22), a selection of rear attachment positions, and selections of shapes and forms of arm sleeves, torso enclosures, thigh enclosures, lower-leg enclosures, feet enclosures and base enclosures are provided.

29 Claims, 3 Drawing Sheets

CLOTHING FOR PHYSICALLY IMPAIRED

BACKGROUND OF THE INVENTION

This invention relates to clothing for physically impaired people, particularly for those confined to wheelchairs.

Dressing and undressing physically impaired people, particularly those in wheelchairs who cannot dress and undress themselves, is a difficult and time-consuming task. Normal clothing is so difficult to get off and on them that it is used with much difficulty.

Different but related clothing for handicapped people is described in the following patent documents: U.S. Pat. No. 5,283,909, issued to Hill on Feb. 8, 1994, described a lap-hugger blanket for wheelchair patients; U.S. Pat. No. 5,062,159, issued to Jakub on Nov. 5, 1991, taught a hospital gown for patients; U.S. Pat. No. 4,944,042, issued to DeWan on Jul. 31, 1990, described a jacket with a pouch into which the jacket could be tucked for convenient carrying and storage; U.S. Pat. No. 4,932,077, issued to Dobbs on Jun. 12, 1990, taught a leg robe for a wheelchair occupant; and U.S. Pat. No. 2,716,239, issued to Barndollar on Aug. 30, 1955, taught a bag-like garment with a front zipper for a wheelchair patient.

Known clothing for patients and handicapped people does not provide the ease of dressing and undressing, the versatility for different use conditions, the comfort, the reliability and aesthetic design capability as taught by this invention.

SUMMARY OF THE INVENTION

In light of need for improvement of clothing and clothing systems for physically impaired people in wheelchairs, objects of this invention are to provide clothing for the physically impaired which:

- Can be put onto and taken off of physically impaired people conveniently and easily while they are in a wheelchair;
- Prevents uncomfortable seams and gatherings of material under and behind bodies of people in wheelchairs;
- Provides access for attachment straps for attaching limp bodies to wheelchairs;
- Can be structured for a wide variety of use conditions with a wide variety of materials; and
- Is adaptable to a wide variety of aesthetic designing.

This invention accomplishes these and other objectives with clothing for physically impaired people having a top garment section and a bottom garment section with which a physically impaired person is dressed while in a wheelchair or on other handicap or even normal furniture. The top garment section has arm sleeves, a wraparound torso enclosure with rear fastening, attachment-strap orifices and hand-covers. The bottom garment section has wraparound abdomen enclosure, wraparound thigh enclosure, lower-leg wraparound enclosure, and wraparound feet-and-base enclosure with respectively select rear fastening. The bottom garment section is attachable to the top garment section. A selection of attachment means, a selection of rear attachment positions, and selections of shapes and forms of arm sleeves, torso enclosures, thigh enclosures, lower-leg enclosures, feet enclosures and base enclosures are provided.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
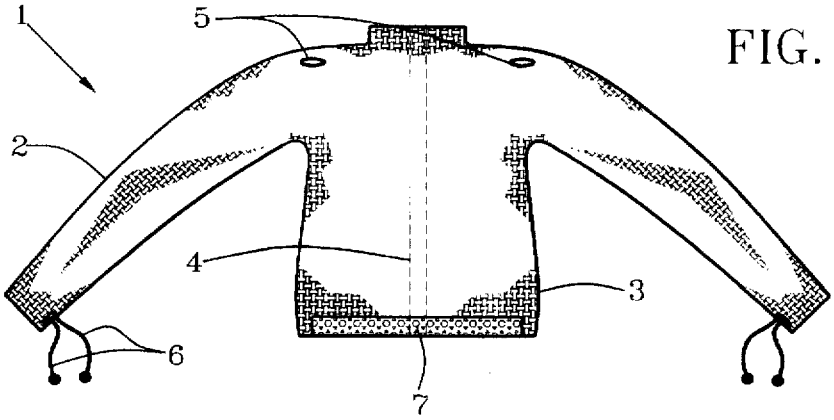
FIG. 1 is a front plan view of a top garment section with optionally hand-enclosure sleeves and central back fastening with such means as VELCRO®.
Figure 2:
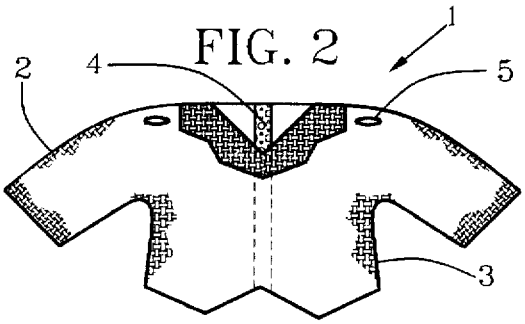
FIG. 2 is a fragmentary front view of a top garment section with optionally short sleeves.
Figure 3:
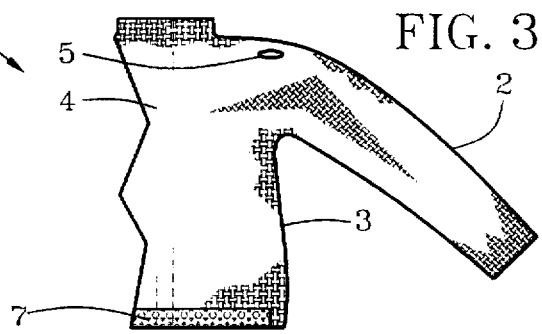
FIG. 3 is a fragmentary front view of a top garment section with wrist-length sleeves.
Figure 4:
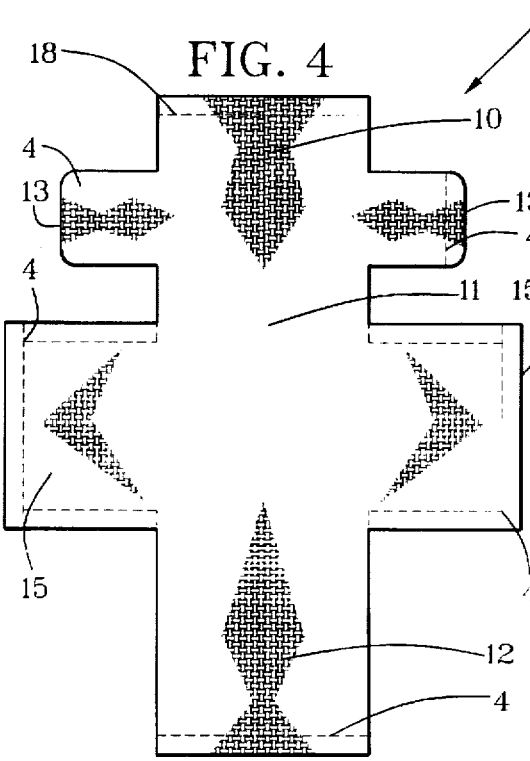
FIG. 4 is a plan view of a bottom garment section with equal-length wraparound portions for central fastening.
Figure 5:
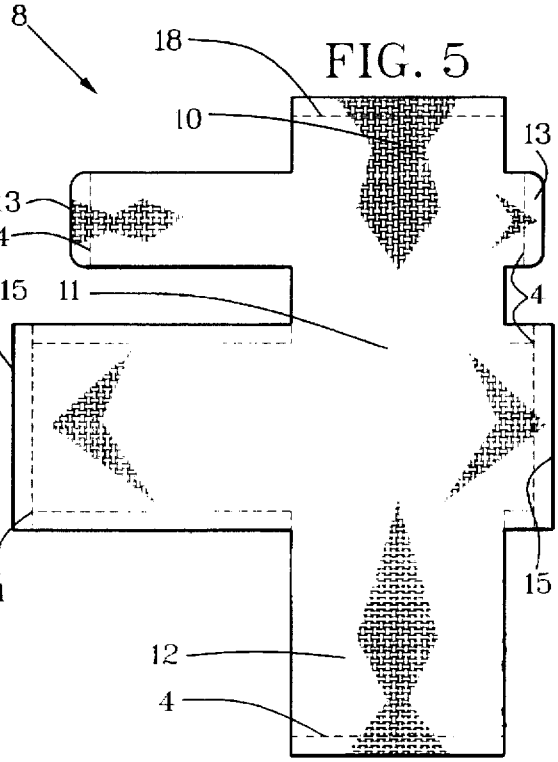
FIG. 5 is a plan view of a bottom garment section with unequal-length wraparound portions for side-rear fastening.
Figure 6:
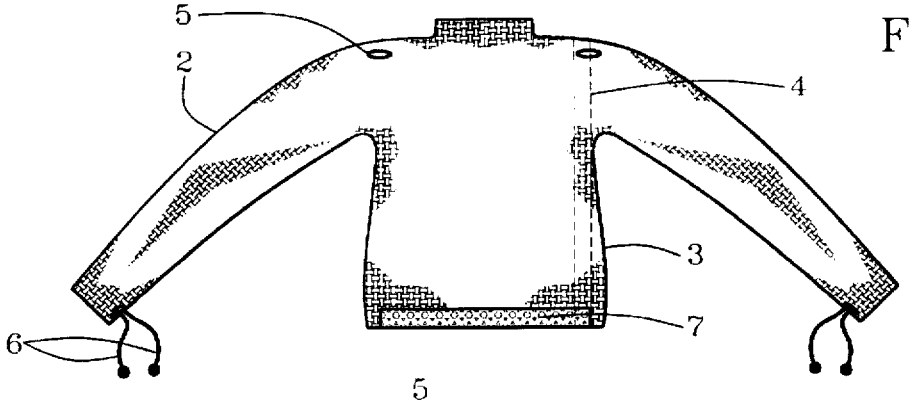
FIG. 6 is a front plan view of a top garment section with optionally hand-enclosure sleeves and side-rear fastening in a fastened mode.
Figure 7:
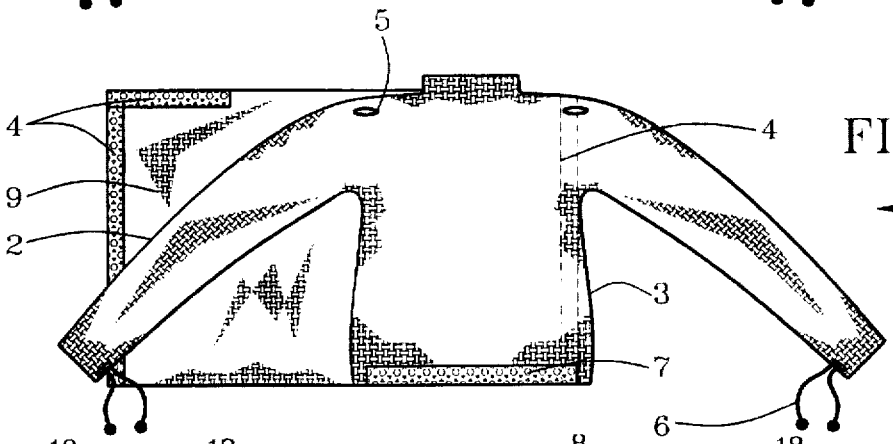
FIG. 7 is the FIG. 6 illustration in an unfastened mode.
Figures 8, 9:
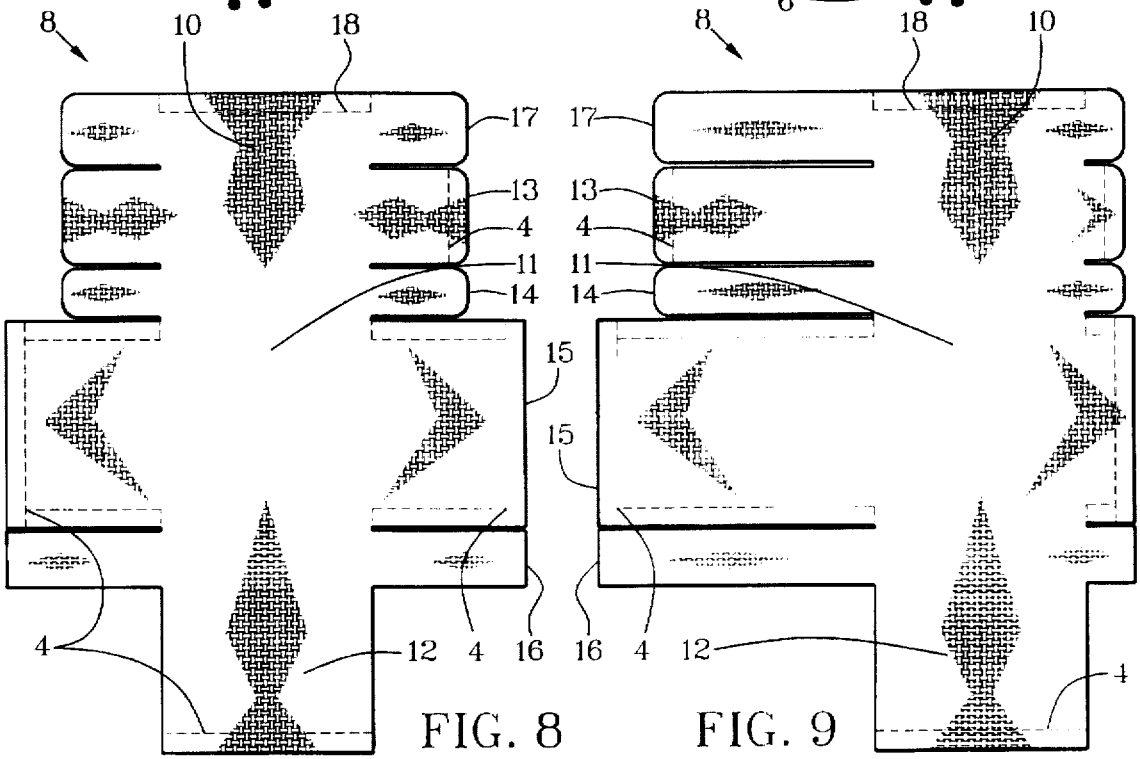
FIG. 8 is a plan view of a bottom garment section with a wider selection of equal-length wraparound portions for central fastening than in the FIG. 4 illustration.
FIG. 9 is a plan view of a bottom garment section with a wider selection unequal-length wraparound portions for side-rear fastening than in the FIG. 5 illustration.

Reference is made first to FIGS. 1–3 and 6–7 in the drawings. A top garment section 1 has arm sleeves 2, a torso cover 3 with a rear fastener 4 and an attachment-strap fastener 5. The arm sleeves 2 can be long to cover hands of a wearer for warmth and have a draw string 6 to close ends of the arm sleeves for retaining body heat as depicted in FIGS. 1 and 6–7. Optionally, the arm sleeves 2 can be short as depicted in FIG. 2 or wrist length as shown in FIG. 3.

The top garment section 1 is structured to be put onto a person from their front and then fastened with the rear fastener 4 that can be VELCRO® and positioned centrally. A bottom attachment 7 such as a strip of VELCRO® can be positioned proximate a bottom of the top garment section 1 for attachment of bottom garment section 8 that is illustrated in FIGS. 4–5, 8–9 and 14–15. Either the top garment section 1 or the bottom garment section 8 can be positioned outside for fastening. Also, strap or suspension fastening between separated top garment sections 1 and bottom garment sections 8 can be employed.

Optionally as depicted in FIGS. 6–7, the rear fastener 4 can be a side-rear fastener with one portion of the rear fastener 4 positioned on either side of a rear of the top garment section 1. A mating portion of the rear fastener 4 is positioned on a torso wraparound 9 that is structured onto a select side of the top garment section 1 that is opposite to the portion of the rear fastener 4 that is positioned on a side rear portion of the top garment section 1.

Figure 14:
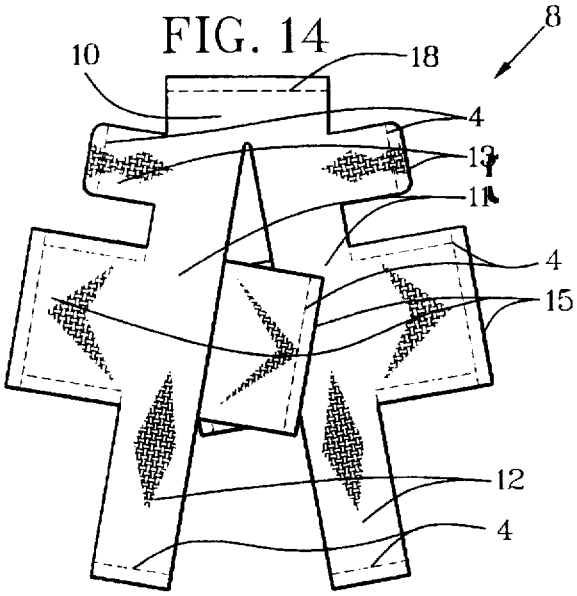
FIG. 14 is a plan view of a bottom garment section with optionally double one-leg cover and select wraparound portions for central-rear fastening.
Figure 15:
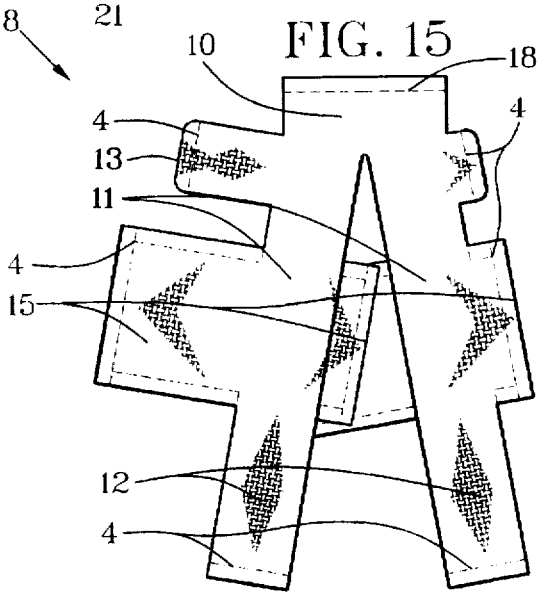
FIG. 15 is a plan view of a bottom garment section with optionally double one-leg cover and select wraparound portions for side-rear fastening.

Referring to FIGS. 4–5, 8–9 and 14–15, the bottom garment section 8 can be a single two-leg cover as depicted in FIGS. 4–5 and 8–9 or a double one-leg cover as depicted in FIGS. 14–15. The single two-leg covers and the double one-leg covers have an abdomen-cover portion 10, a leg-cover portion 11, and a feet-covering portion 12 with select rear fasteners 4 which can be similar to the rear fastener 4 on the top garment section 1.

Extended laterally from the bottom garment section 8 are select wraparound extensions. The select wraparound extensions can include thigh-wraparound extensions 13 which are sized, shaped and structured to wrap around a design portion of a physically impaired person's thighs. Knee-wraparound extensions 14 can be sized, shaped and structured to wrap around a design portion of the physically impaired person's knees. Lower-leg-wraparound extensions 15 can be sized, shaped and structured to wrap around a design portion of the physically impaired persons lower legs. Feet-wraparound extensions 16 can be sized, shaped and structured to wrap around a design portion of the physically impaired person's feet. Optionally also for some weather conditions and use conditions, abdomen-wraparound extensions 17 are sized, shaped and structured to wrap around a design portion of the physically impaired person's abdomen designedly intermediate a bottom of the top garment section and a leg portion of the physically impaired person.

The wraparound extensions have select rear fasteners 4 which can be positioned at designedly rear portions of the physically impaired person respectively. The rear fasteners 4 are designed for a select type of material and select positioning, such that the wraparound extensions can be positioned selectively behind and under the physically impaired person and then fastened while respective portions of the physically impaired person are separated selectively from contact with a wheelchair or other handicap furnishing on which the physically impaired person is positioned. The wraparound extensions can be extended designedly from either or both sides of respective portions of the bottom garment section 8 in accordance with where on a physically impaired person's back the rear fasteners 4 are designed to meet and be fastened.

The bottom garment section 8 can have a top attachment 18 with which the bottom garment section 8 can be attached to the top garment section 1. The bottom attachment 7 shown in FIGS. 1, 3, 6 and 7 can be matched to the top attachment 18.

Figure 10:
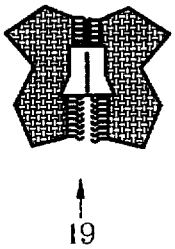
FIG. 10 is a representation of a zipper fastener as an option to such fastening means as VELCRO®.
Figure 11:
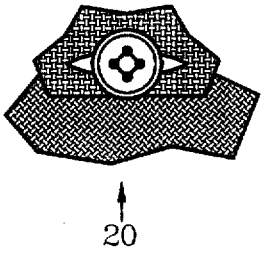
FIG. 11 is a representation of a button fastener as an option to such fastening means as VELCRO®.
Figure 12:
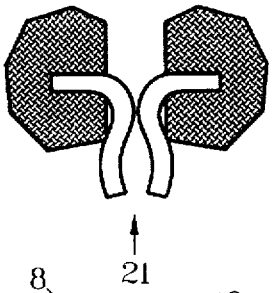
FIG. 12 is a representation of a strap fastener as an option to such fastening means as VELCRO®.
Figure 13:
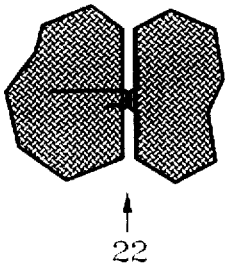
FIG. 13 is a representation of a hook fastener as an option to such fastening means as VELCRO®.

Optional selectively to such fastener means as VELCRO® indicated in FIGS. 1–9 and 14–15 for the rear fasteners 4, the bottom attachment 7, the top attachment 18 and the rear fastener 4 can be various types of zippers 19 represented in FIG. 10, buttons 20 represented in FIG. 11, straps 21 represented in FIG. 12 and hooks 22 represented in FIG. 13.

The wraparound extensions and all other material components can be sewn onto or allowed to remain on the top garment section 1 and the bottom garment section 8 in accordance with appropriate construction practices. In particular, it is necessary to sew on centrally extended wraparound extensions for the illustrations in FIGS. 14–15. Considerable sewing-on and/or sewing-together will be required or advantageous for construction of the top garment section 1. The same selection of wraparound extensions can be provided for the single two-leg covers illustrated in FIGS. 4–5 and 8–9 as for the double one-leg covers illustrated in FIGS. 14–15, assuming appropriate design and construction capability.

Figure 16:
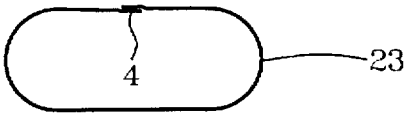
FIG. 16 is a sectional top view of a central-rear overlap for fastening either top or bottom garment sections.
Figure 17:
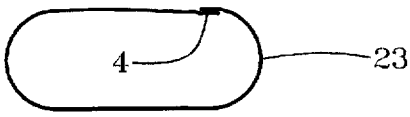
FIG. 17 is a sectional top view of a side-rear overlap for fastening either top or bottom garment sections.
Figure 18:
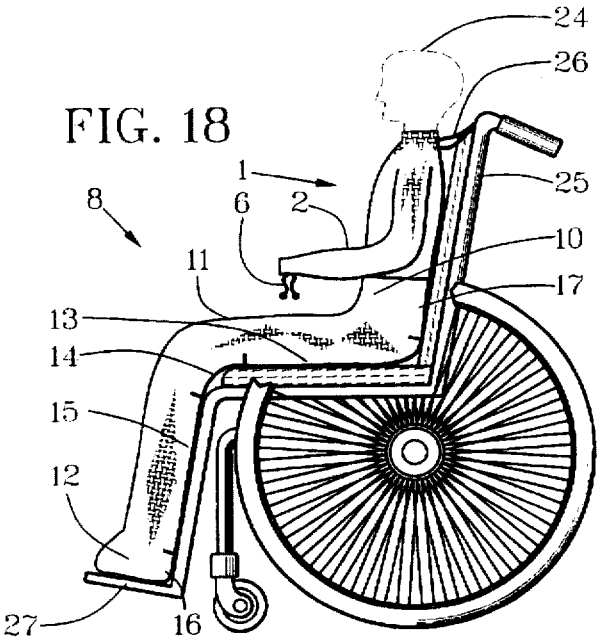
FIG. 18 is a partially cutaway side elevation view of a physically impaired person dressed in select top and bottom garment sections and sitting in a wheelchair.

Referring to FIGS. 16–18, a rear fastener 4 is shown as an overlap of ends of wraparound extensions of a representative garment section 23. In FIG. 16, the rear fastener 4 is positioned centrally, while in FIG. 17, the rear fastener 4 is positioned at a side rear of the representative garment section 23 as it would be in relation to a back of a physically impaired person. Where to have the rear fastener 4 can be in accordance with design preference. Side-rear positioning illustrated in FIG. 17 allows a caretaker to hold a body of a physically impaired person 24, depicted in FIG. 18, with the caretaker's left hand while positioning wraparound extensions behind and/or under the physically impaired person's body with the caretaker's right hand and then allows the caretaker to use mostly their right hand for fastening the rear fasteners 4 with the physically impaired person on a wheelchair 25 or other handicap furnishing. The physically impaired person 24 can be supported upright in the wheelchair 25 with an attachment strap 26 that can be fastened to an appropriate attachment-strap fastener 5 such as orifices depicted in FIGS. 1–3 and 6–7. Appropriate side-rear positioning of the rear fasteners 4 also places uncomfortable obstruction of some types of fastener means where they are more out of the way. Central positioning, however, provides equality of access by right-handed and left-handed caretakers.

The feet-covering portion 12 can be structured to wrap around a foot rest 27 in addition to being wrapped around feet of a physically impaired person 24 or, optionally, to wrap around only their feet as depicted in FIG. 18.

New and useful clothing for physically impaired having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. Clothing for the physically impaired comprising:

a top garment section and a bottom garment section;

the top garment section having arm sleeves, a torso cover with a rear fastener, and an attachment-strap fastener having at least one attachment orifice that is sized and shaped to receive an attachment strap in fastener relationship between the top garment section and a wheelchair on which the physically impaired person is positioned;

the bottom garment section having an abdomen cover, leg cover with a rear fastener and feet covering with a rear fastener said leg cover includes a thigh cover portion and said thigh cover portion has thigh wrap around extensions that are sized, shaped and structured to wrap around a portion of the physically impaired person's thighs; said leg cover portion includes a lower-leg-cover portion having lower leg wrap around extensions that are sized and shaped and structured to wrap around a portion of the physically impaired person's lower legs; and an attachment means joining the top garment section to the bottom garment section.

2. Clothing for the physically impaired as described in claim 1 wherein:

the torso cover is sized, shaped and structured to wrap around the physically impaired person's torso intermediate a neck area and an abdomen area of the physically impaired person; and a rear fastener of the torso cover is positioned centrally intermediate opposite sides of a back of the physically impaired person's body, such that the torso cover can be positioned on the physically impaired person's body by insertion of arms of the physically impaired person in the arm sleeves and then fastening the rear fastener of the torso cover while the physically impaired person's torso is separated selectively from contact with a back of a wheelchair or other handicap furnishing on which the physically impaired person is positioned.

3. Clothing for the physically impaired as described in claim 2 wherein:

the rear fastener is a pliable hook type of fastener such as VELCRO®.

4. Clothing for the physically impaired as described in claim 2 wherein:

the rear fastener is a zipper type of fastener.

5. Clothing for the physically impaired as described in claim 2 wherein:

the rear fastener is a button type of fastener.

6. Clothing for the physically impaired as described in claim 2 wherein:

the rear fastener is a strap type of fastener.

7. Clothing for the physically impaired as described in claim 2 wherein:

the rear fastener is a hook-and-eye type of fastener.

8. Clothing for the physically impaired as described in claim 1 wherein:

the torso cover is sized, shaped and structured to wrap around the physically impaired person's torso intermediate a neck area and an abdomen area of the physically impaired person; and a rear fastener of the torso cover is positioned proximate a side of a back of the physically impaired person's body, such that the torso cover can be positioned on the physically impaired person's body by insertion of arms the physically impaired person in the arm sleeves and then fastening the rear fastener of the torso cover while the physically impaired person's torso is separated selectively from contact with a back of a wheelchair or other handicap furnishing on which the physically impaired person is positioned, and the rear fastener of the torso cover is positioned to a side of the physically impaired person's body in order to prevent discomfort at a back of the physically impaired person.

9. Clothing for the physically impaired as described in claim 8 wherein:

the rear fastener is a select type of fastener for a type of material and structure of the torso cover.

10. Clothing for the physically impaired as described in claim 1 wherein:

the arm sleeves are a long-sleeved type.

11. Clothing for the physically impaired as described in claim 10 wherein:

hand protection is positioned proximate distal ends of the arm sleeves.

12. Clothing for the physically impaired as described in claim 11 wherein:

the hand protection is extension of the arm sleeves to positions beyond ends of arms and hands of the physically impaired person; and selective closures on ends of the arm sleeves, such that the arm sleeves can be closed by such closure to prevent entry of cold air into the arm sleeves when desired.

13. Clothing for the physically impaired as described in claim 1 wherein:

the abdomen cover of the bottom garment section is sized, shaped and structured to cover a portion of a front of the physically impaired person's abdomen intermediate a bottom of the top garment section and a leg portion of the physically impaired person.

14. Clothing for the physically impaired as described in claim 13 wherein:

the abdomen cover of the bottom garment section has abdomen-wraparound extensions that are sized, shaped and structured to wrap around a portion of the physically impaired person's abdomen intermediate a bottom of the top garment section and a leg portion of the physically impaired person.

15. Clothing for the physically impaired as described in claim 13 wherein:

the abdomen-wraparound extensions have abdomen rear fasteners at a portion of a rear of the physically impaired person's abdomen; and the rear fasteners are designed for a select type of material and select positioning of the rear fasteners, such that the abdomen-wraparound extensions can be positioned selectively behind and under the physically impaired person and then fastened while the physically impaired person's abdomen is separated selectively from contact with a back and a bottom of a wheelchair or other handicap furnishing on which the physically impaired person is positioned.

16. Clothing for the physically impaired as described in claim 1 wherein:

the leg cover is a single two-leg cover.

17. Clothing for the physically impaired as described in claim 16 wherein:

the single two-leg cover has said thigh-cover portion, a knee-cover portion, said lower-leg-cover portion and a feet-cover portion.

18. Clothing for the physically impaired as described in claim 17 wherein:

the thigh-wraparound extensions have thigh rear fasteners at a portion of a rear of the physically impaired person's thighs; and the rear fasteners are designed for a select type of material and select positioning of the rear fasteners, such that the thigh-wraparound extensions can be positioned selectively behind and under the physically impaired person's thighs and then fastened while the physically impaired person's thighs are separated selectively from contact with a bottom of a wheelchair or other handicap furnishing on which the physically impaired person is positioned.

19. Clothing for the physically impaired as described in claim 17 wherein:

the knee-cover portion has knee-wraparound extensions that are sized, shaped and structured to wrap around a portion of the physically impaired person's knees.

20. Clothing for the physically impaired as described in claim 19 wherein:

the knee-wraparound extensions have knee rear fasteners at a portion of a rear of the physically impaired person's knees; and the rear fasteners are designed for a select type of material and select positioning of the rear fasteners, such that the knee-wraparound extensions can be positioned selectively behind and under the physically impaired person's knees and then fastened while the physically impaired person's knees are separated selectively from contact with a bottom of a wheelchair or other handicap furnishing on which the physically impaired person is positioned.

21. Clothing for the physically impaired as described in claim 17 wherein:

the lower-leg-wraparound extensions have lower-leg rear fasteners at a portion of a rear of the physically impaired person's lower-legs; and the rear fasteners are designed for a select type of material and select positioning of the rear fasteners, such that the lower-leg-wraparound extensions can be positioned selectively behind and under the physically impaired person's lower-legs and then fastened while the physically impaired person's lower-legs are separated selectively from contact with a bottom of a wheelchair or other handicap furnishing on which the physically impaired person is positioned.

22. Clothing for the physically impaired as described in claim 17 wherein:

the feet-cover portion has feet-wraparound extensions that are sized, shaped and structured to wrap around a portion of the physically impaired person's feet.

23. Clothing for the physically impaired as described in claim 22 wherein:

the feet-wraparound extensions have feet rear fasteners at a portion of a rear of the physically impaired person's feet; and the rear fasteners are designed for a select type of material and select positioning of the rear fasteners, such that the feet-wraparound extensions can be positioned selectively behind and under the physically impaired person's feet and then fastened while the physically impaired person's feet are separated selectively from contact with a bottom of a wheelchair or other handicap furnishing on which the physically impaired person is positioned.

24. Clothing for the physically impaired as described in claim 23 wherein:

the feet-wraparound sections are sized, shaped and structured to wrap around a foot-base portion of a wheelchair or other handicap furnishing on which the physically impaired person is positioned in addition to being wrapped around the physically impaired person's feet.

25. Clothing for the physically impaired as described in claim 1 wherein:

the leg cover is a double one-leg cover.

26. Clothing for the physically impaired as described in claim 25 wherein:

the double one-leg cover has thigh-cover portions, knee-cover portions, lower-leg-cover portions and feet-cover portions.

27. Clothing for the physically impaired as described in claim 26 wherein:

the thigh-cover portions, the knee-cover portions, the lower-leg-cover portions, and the feet-cover portions have wraparound extensions that are sized, shaped and structured to wrap around a portion of the physically impaired person's thighs, knees, lower legs and feet respectively.

28. Clothing for the physically impaired as described in claim 27 wherein:

the wraparound extensions have rear fasteners which can be positioned at respective rear portions of the physically impaired person; and the rear fasteners are designed for a select type of material and select positioning of the rear fasteners, such that the wraparound extensions can be positioned selectively behind and under the physically impaired person and then fastened while respective portions of the physically impaired person are separated selectively from contact with a wheelchair or other handicap furnishing on which the physically impaired person is positioned.

29. Clothing for the physically impaired as described in claim 1 wherein:

the bottom garment section is attachable to the top garment section.

* * * * *